US005226776A

United States Patent [19]

Vestergaard

[11] Patent Number: 5,226,776

[45] Date of Patent: Jul. 13, 1993

[54] FOLDABLE LINK ROD FOR CARRYING AN OPERATIVE PLATFORM

[76] Inventor: Godtfred Vestergaard, Niels Frederiksensvej 18, DK-4000 Roskilde, Denmark

[21] Appl. No.: 785,150

[22] Filed: Oct. 31, 1991

Related U.S. Application Data

[63] Continuation of Ser. No. 460,174, Mar. 13, 1990, abandoned.

[30] Foreign Application Priority Data

May 17, 1988 [DK] Denmark ..... 2698/88

[51] Int. Cl.[5] ..... B66C 23/06; B66C 23/04

[52] U.S. Cl. ..... 414/680; 212/231; 212/232; 212/256; 212/265; 182/2; 414/700; 414/706

[58] Field of Search ..... 417/917, 700; 901/15; 212/223, 227, 231-232, 237-238, 246, 255-256, 260-261, 265; 182/2; 414/680, 685, 687, 688, 706-708, 744.3

[56] References Cited

U.S. PATENT DOCUMENTS

| | | | |
|---|---|---|---|
| 2,674,500 | 4/1954 | Hukari | 182/2 |
| 3,149,694 | 9/1964 | Smithee | 182/2 |
| 3,244,292 | 4/1966 | Elliot | 212/238 |
| 3,357,517 | 12/1967 | Wagner | 182/2 |
| 3,775,798 | 12/1973 | Thornton-Trump | 212/238 |
| 3,792,782 | 2/1974 | Melton | 901/15 |
| 3,891,051 | 6/1975 | Ashworth | 182/2 |
| 4,179,010 | 12/1979 | Asworth | 212/231 |
| 4,646,875 | 3/1987 | Sholl | 212/266 |

FOREIGN PATENT DOCUMENTS

| | | | |
|---|---|---|---|
| 3120338 | 5/1981 | Fed. Rep. of Germany | 182/2 |
| 941002 | 7/1982 | U.S.S.R. | 414/917 |

*Primary Examiner*—Joseph F. Peters, Jr.
*Assistant Examiner*—R. B. Johnson
*Attorney, Agent, or Firm*—Silverman, Cass & Singer, Ltd.

[57] ABSTRACT

Foldable link rod system to be placed on a travelling frame comprises pivotally suspended link rods (16, 18) for raising and lowering an operation platform (14). A rotating stool (20) constitutes the connection between two link rods (16 and 18) which are placed in continuation to each other. The one part of the rotating stool (20) is linked to the free end of the first link rod (16) which at its opposite end is pivotally linked to a swinging rod system (26, 28, 30, 32). The second link rod (18) is linked to the other part of the rotating stool and at its other end it is linked to the operation platform (14). The two link rods are pivotal by means of each of their swinging devices (54–70) which are supported on the travelling frame (10, 12) and the rotating stool (20), respectively. The swinging rod system (26, 28, 30, 32) is adapted to communicate a swinging movement to the first link rod (16), the free end of which follows or yet is close to a leadline intersecting this end in one of the end positions of the link rod. At the same time, the rotating stool (20) of the swinging rod system (26, 28, 30, 32) is kept in a mainly horizontal position.

1 Claim, 3 Drawing Sheets

FOLDABLE LINK ROD FOR CARRYING AN OPERATIVE PLATFORM

Figure 1B:
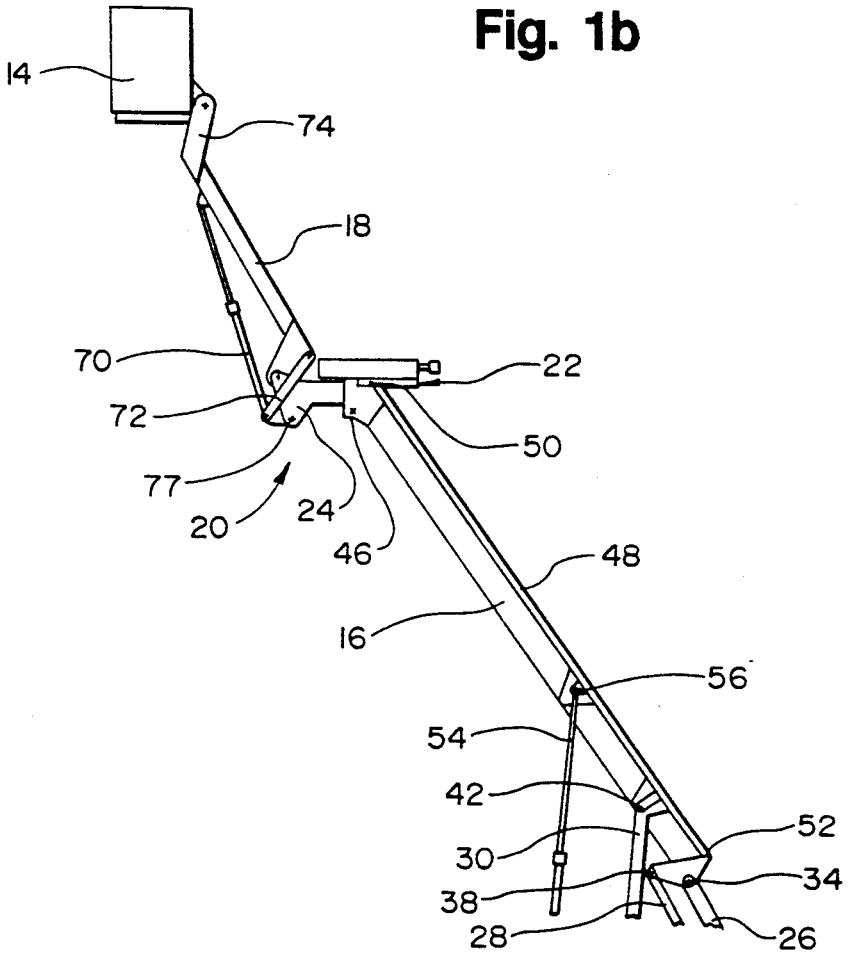

This is a continuation of application Ser. No. 07/460,174 filed Mar. 13, 1990 now abandoned.

The invention relates to a foldable link rod system to be placed on a travelling frame comprising pivotally connected link rods for raising and lowering an operation platform, said system includes a rotating stool for swinging an operation platform on a mainly horizontal movement plane.

During the past years, link rod systems of this kind have been used in many different fields, among others for mounting and maintaining buildings and installations. A special task has been the deicing of aircrafts. In this case, the link rod system is placed on a carriage provided with a deicing device and utilized for manoeuvring a nozzle to atomize a deicing medium.

The object of the present invention is to provide a link rod system which is characterized in a particularly good manoeuvrability which makes it possible to advantageously use it for tasks demanding great mobility combined with a particularly rapid accomplishment of the task, for instance the deicing of aircrafts immediately before they are taking off.

According to the invention, this object is attained by the fact that the rotating stool constitutes the connection between two link rods which are placed in continuation of each other, in as much as the one part of the rotating stool is linked to the free end of the first link rod which mainly is placed above a centre line of the travelling frame and which at its opposite end is pivotally linked on a mainly vertical plane to a swinging rod system orientated on the swinging plane of the rod, and the second link rod is, also for swinging on a mainly vertical plane, linked to the other part of the rotating stool and at its other end it is linked to the operation platform, and by the fact that the two link rods are pivotal by means of each of their swinging devices which are supported on the travelling frame and the rotating stool respectively, and that the swinging rod system is adapted to communicate a swinging movement to the mentioned first link rod, where the mentioned free end of the link rod follows or yet is close to a leadline intersecting this end in one of the end positions of the link rod and at the same time, that the rotating stool of the swinging rod system is kept in a mainly horizontal position.

In contradistinction to known link rod systems of the kind disclosed, the rotating stool thus does not constitute any longer the lowest anchoring part of the structure which, for instance, should bear the two mentioned link rods, but an intermediate link movably connecting the mentioned second link rod with mentioned first link rod. That means that the first link rod only needs to be pivotal up and down but not also rotatably anchored with i.e. the travelling frame. This results in a reduction of the mass which has to be moved when the operation platform has to be moved sideways. The sidewise movement can be achieved by only turning the rotating stool placed at the free end of the first link rod whereby the second link rod is swung sideways.

It is possible to control the swinging up and down movement of the second link rod in a simple way, without depending on the up and down swinging of the mentioned first link rod. That means in practice that the system when used to deice aircrafts rapidly can be accomodated to different sizes of aircrafts by adjusting the height and at the same time, the necessary working distance from the engine is kept. The front of the operation platform can at any time be kept face to the object to be worked on without for this purpose being obliged to move any heavy mass.

As the first link rod mainly shall be placed about the centre line of the travelling frame, a good stability is ensured as the heavier elements of the link rod system are retained above that centre line. While working, only the small masses of the second link rod and the operation platform will be moved over the wheel base of the vehicle.

With a view to deice aircrafts, the system according to the invention brings about the specific substantial advantage that the supply conduits necessary for delivering the spraying media for the purpose of deicing, from the travelling frame to the operation platform may get a simple and thus reliable structure as the functioning of the link rod system is not based upon a change of the length of the link rods of the system.

Figure 1A:
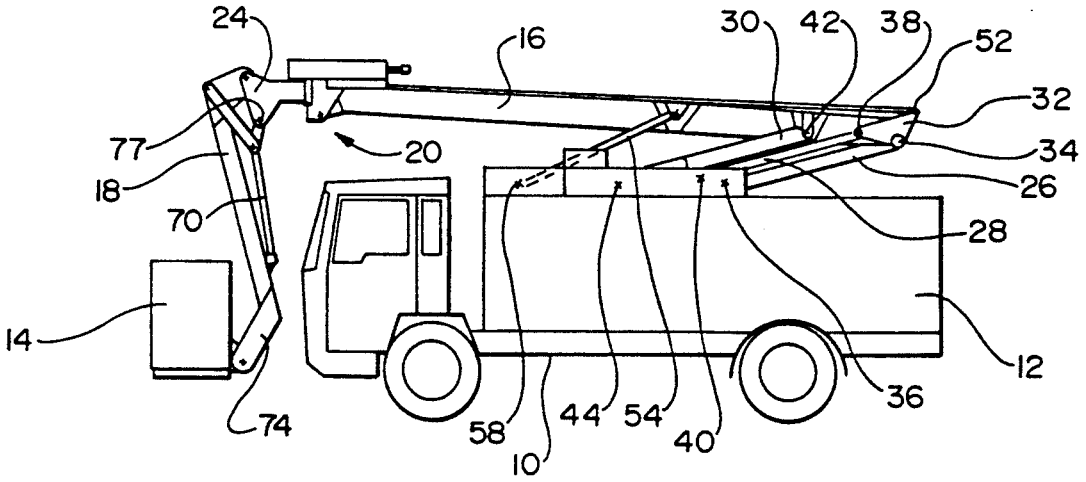
Figure 2:
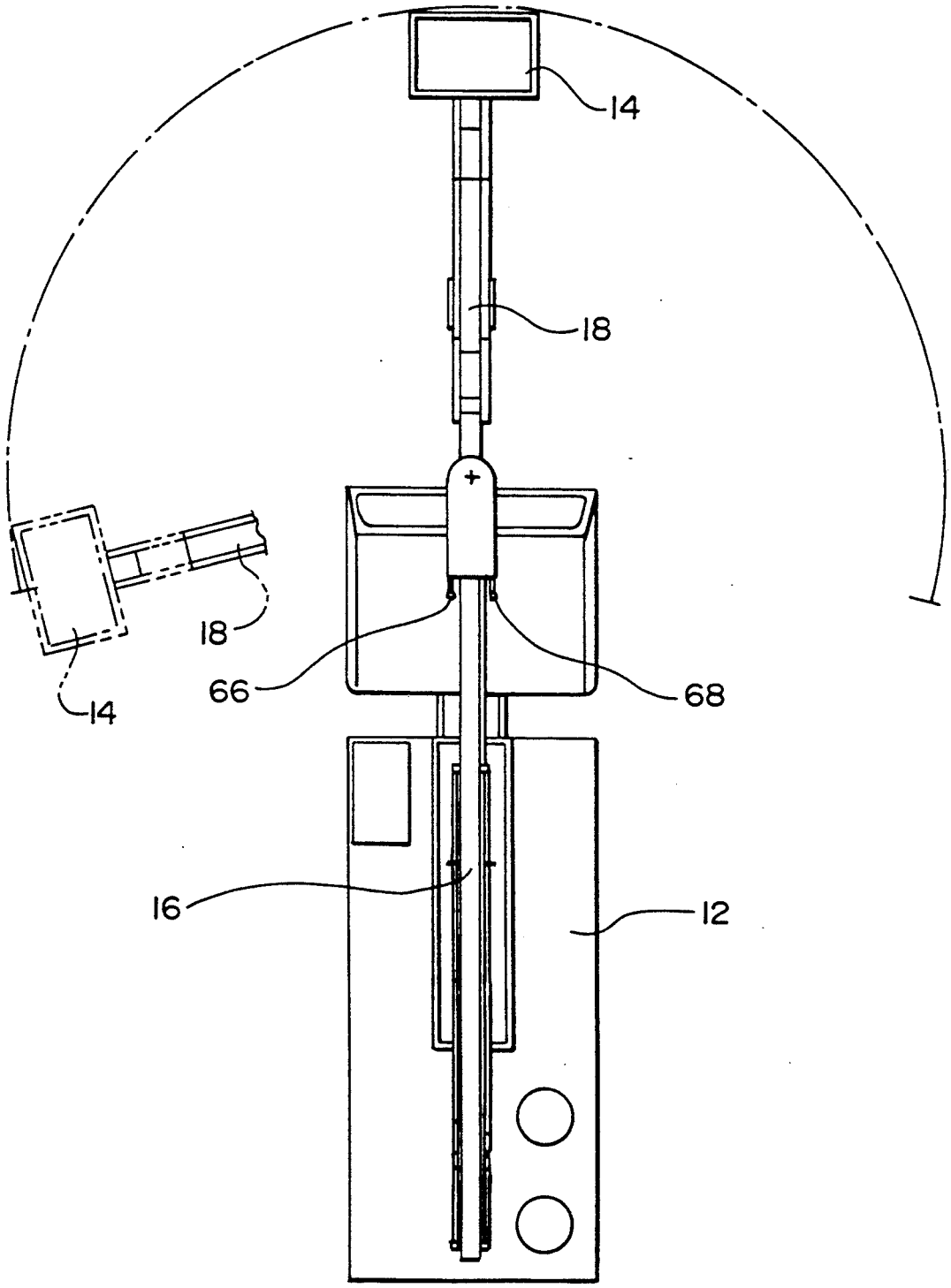
Figure 3:
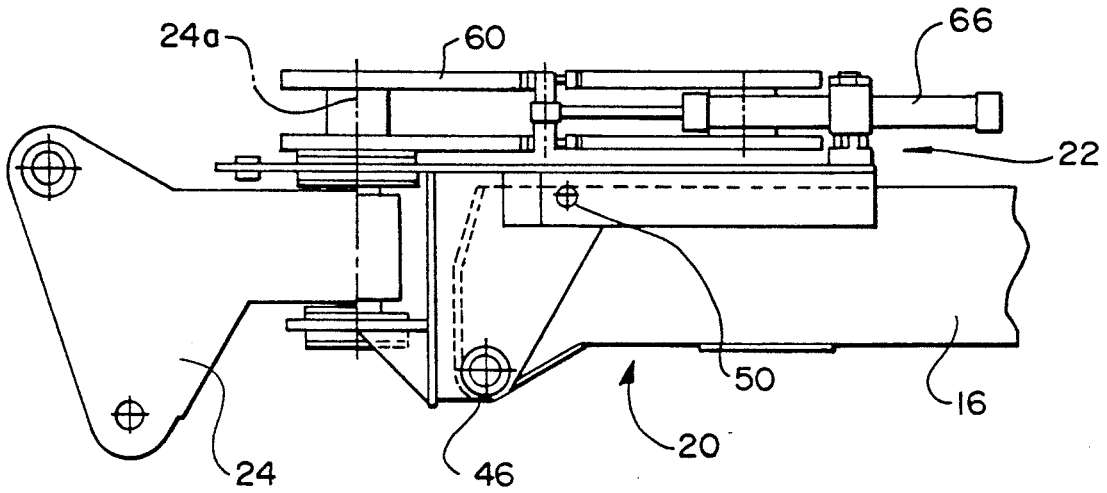
Figure 4:
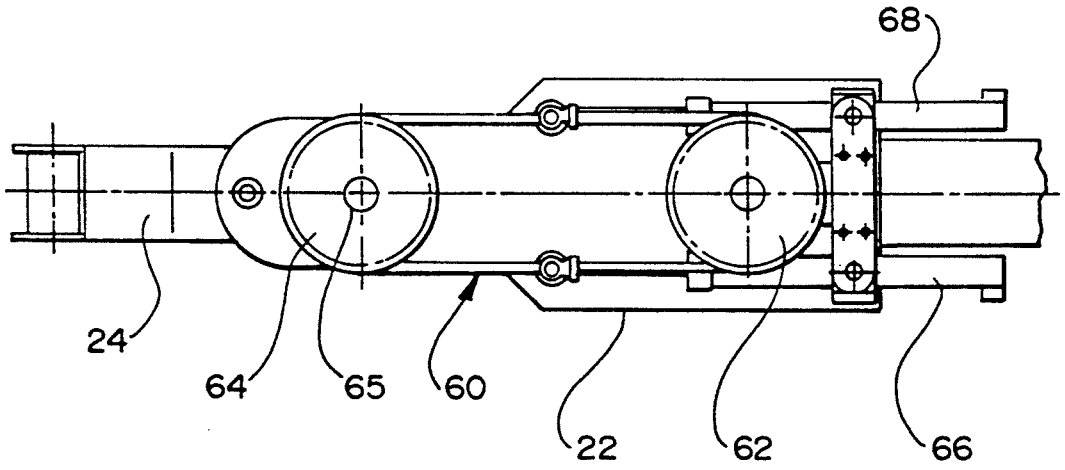

An embodiment of a foldable link rod system according to the invention will be explained in the following detailed description, reference being made to the accompanying drawing on which FIG. 1*a* shows an embodiment of the link rod system according to the invention mounted on a travelling frame in the transport position, FIG. 1*b* shows the link rod system of FIG. 1*a* in an extended or operating position and without the travelling frame, FIG. 2 shows the same seen from above and in operating position, FIG. 3 on an enlarged scale the rotating stool with chain driver of the system, seen from the side, and FIG. 4 shows the stool according to FIG. 3, seen from above.

The invention will be described in connection with a vehicle intended for the deicing of aircrafts. Generally, such a deicing is carried out immediately before the taking off of the aircraft.

The vehicle 10 comprises an engine housing 12 containing a not specified system for spraying a deicing medium. The spraying is carried out from an operation platform 14. It will be possible to use that platform to other tasks too, for instance to the accomplishment of repairs.

The link rod system comprises two link rods 16 and 18, which are placed in continuation of each other and by means of a rotating stool 20 connected with each other, in as much as the first part 22 of said stool is hinged to the free outer end of the lowest link rod 16 by means of a pivot 46 and its second part 24 is hinged to the lower end of the second link rod 18.

The lowest link rod 16 is pivotally anchored on a vertical plane with a swinging rod system consisting of a pair of parallel rods 26 and 28 and a control lever 30 which is mounted on the roof of the engine housing 12 in such a way that the system and the link rod 16 are mainly placed above the centre line of the vehicle 10. The control lever 30 is a supporting lever for supporting the link rod 16 in its extended or swinging position illustrated in FIG. 1*b*.

The anchoring comprises a two-armed swinging arm 32 which by means of a journal 34 is pivotally connected with both the lowest end of the link rod 16 and the projecting end of the parallel rod 26. The pivotal anchoring of the parallel rod 26 with the engine housing 12 is designated with 36. At its one end 38, the parallel rod 28 is pivotally connected with the left arm of the swinging arm 32, and at its other end 40 it is pivotally anchored with the engine housing 12. The control lever 30 of the anchoring is at its one end 42 pivotally connected with the link rod 16 at a distance from the lowest end of the latter and by a pivot 44 anchored with the engine housing 12.

By means of a pivot 46, the rotating stool 20 is pivotally connected in the drawing plane of FIG. 16 with the outer end of the link rod 16. By means of a pivot 50, a control lever 48 is, at its one end, pivotally connected with the rotating stool 20, and at its other end it is, by means of a pivot 52, pivotally connected with the right arm of the swinging arm 32.

The link rod 16 can be swung up and down by means of a hydraulic piston driver 54 which is also placed on the roof of the engine housing 12. By means of the pivots 56 and 58, the driver 54 is connected with the link rod 16 and the roof of the engine housing 12, respectively.

As it further appears from the drawing, the proportions of length of the rods 26,28,30 of the swinging rod system and the placing of their pivotal connections with the link rod 16 and the engine housing 12, respectively, are chosen in such a way that an upward swing of the link rod 16 by activating the hydraulic piston driver 54 results in a nearly vertical lifting of the rotating stool 20 from the transport position shown in FIG. 1*a* where the link rod 16 is swung to a laying position along the roof of the engine housing 12, to an operating position shown in FIG. 1*b*. In this position, all the heavier elements of the system, i.e. the swinging rod system 26, 28, 30, the link rod 16 and the rotating stool 20 are still above the centre line of the vehicle 10 which gives a good balance and thus a good manoeuvrability for the vehicle 10.

The hydraulic piston driver 54 while being extended is drawing the lower anchoring members of the swinging rod system 26, 28, 30 of the link rod 16 somewhat to the left by a swinging movement. At the same time, the swinging arm 32 is turning clockwise and thus, via the control lever 48 and the pivot 46, the rotating stool 20 is kept in a horizontal position.

The rotating stool 20 includes a part 22, which is pivotally connected at pivot 46 with the link rod 16 and a part 24 which in relation to the part 22 is pivotal about axis 24*a* and parallel to it and to which the nearest end of the link rod 18 is pivotally connected. The operation platform 14 is hinged to that outer end of that link rod.

All these connections are shaped in such a way that the link rod 18 with the operation platform 14 can be swung from the above-mentioned transport position to the operating position and vice versa. In the operating position, the operation platform 14 can be further swung on a horizontal plane, as indicated in FIG. 2.

In order to be able to swing the platform 14 in the horizontal plane, the rotating stool 20 is, in its shown embodiment, provided with a chain driver which is shaped as an endless twin chain 60, lead around a chain wheel 62 embedded in the stool part 22 and a chain wheel 64 positioned on a drive shaft 65 on which the stool part 24 is also placed. The chain driver is driven by means of a twin piston driver consisting of two piston cylinders 66 and 68 positioned on the part 22 and coupled to their respective parts of the twin chain 60. By means of a common valve, which is not shown and which is preferably placed on the operation platform 14, the cylinders 66 and 68 are steered in order to operate in the opposite way. The length of stroke of the cylinders form a limitation of the extent of the swinging movement.

From the above it appears that the adjustment of the operation height which for instance is determined by the height of the aircraft is carried out by lifting the link rod 16. Most of the time it will be sufficient to raise the link rod 16 to a single starting position and from that position, the operation platform 14, by means of the rotating stool 20 and the link rod 18 can be finally driven to the right operating positions as the link rod 18 is also pivotal on the vertical plane by means of a hydraulic piston driver 70 which, by means of the connecting rods 77 is embedded in the part 24 of the rotating stool. Compared to the other part of the entire link rod system, these elements have a little mass. A link connection 74 between the operation platform 14 and the link rod 18 ensures that the platform at any time is in the right operating position.

Instead of a chain-piston drive mechanism, a system of gears may be used.

I claim:

1. A link rod system comprising:

a vehicle with a housing mounted thereon;

link rod swinging means including a pair of parallel rods and a first control lever pivotable about horizontal axes, driver means for pivotally moving said parallel rods and first control lever about said horizontal axes, pivot means mounting said parallel rods, said first control lever, and driver means being mounted for pivotal movement about said horizontal axes at longitudinally spaced locations on said housing;

a first link rod with a first end and a second end, arm means pivotally connecting said parallel rods to said first link rod at said first end thereof, means pivotally connecting said first control lever to said first link rod at a location adjacent said first end and spaced from said arm means;

a second link rod with a first end and a second end, rotating means for mounting said first end of said second link rod to said second end of said first link rod for rotational movement about spaced horizontal and vertical axes, a second control lever operatively connected to said arm means and said rotating means to maintain the latter in a substantially horizontal plane regardless of any vertical movement of said first and second link rods;

first means mounted on said rotating means for moving said second link rod about the vertical axis, second means mounted on said rotating means for moving said second link rod about the horizontal axis;

an operation platform mounted on said second link rod at said second end thereof, and;

spaced pivot means for connecting said driver means and first control lever to said first link rod, said link rods and operation platform being longitudinally movable in a vertical plane relative to said housing in response to actuation of said driver means.

* * * * *